US011279602B2

(12) United States Patent
Gilbert et al.

(10) Patent No.: US 11,279,602 B2
(45) Date of Patent: Mar. 22, 2022

(54) SMART JACK ARRAY

(71) Applicant: Gilbert Engineering, LLC, Arvada, CO (US)

(72) Inventors: Micky G. Gilbert, Arvada, CO (US); Garrett Hoffman, Arvada, CO (US); Jonathan Carlisle, Arvada, CO (US)

(73) Assignee: GILBERT ENGINEERING, LLC, Arvada, CO (US)

( * ) Notice: Subject to any disclaimer, the term of this patent is extended or adjusted under 35 U.S.C. 154(b) by 265 days.

(21) Appl. No.: 16/711,459

(22) Filed: Dec. 12, 2019

(65) Prior Publication Data

US 2021/0179402 A1 Jun. 17, 2021

(51) Int. Cl.

| | |
|---|---|
| ***B66F 3/44*** | (2006.01) |
| ***B66F 3/08*** | (2006.01) |
| ***B66F 3/36*** | (2006.01) |

(52) U.S. Cl.

CPC ..... *B66F 3/44* (2013.01); *B66F 3/08* (2013.01); *B66F 3/36* (2013.01)

(58) Field of Classification Search

CPC ..... B66F 3/44; B66F 3/08; B66F 3/36; B66F 3/10; B66F 3/46; B66F 7/10; B66F 7/12; B66F 7/14; B66F 17/00; B66F 17/006; B66F 2700/04

See application file for complete search history.

(56) References Cited

U.S. PATENT DOCUMENTS

| | | | | |
|---|---|---|---|---|
| 4,609,179 | A * | 9/1986 | Chern | B66F 3/10 254/102 |
| 5,110,089 | A | 5/1992 | Slay | |
| 8,132,787 | B1 | 3/2012 | Audet | |
| 9,855,929 | B2 | 1/2018 | Bennett | |
| 2002/0171070 | A1 | 11/2002 | Shim | |
| 2005/0161649 | A1 | 7/2005 | Kawasaki | |
| 2010/0140573 | A1 | 6/2010 | Siemers | |
| 2010/0219386 | A1 * | 9/2010 | Venturini | B66F 3/10 254/102 |
| 2013/0277628 | A1 | 10/2013 | Giese | |

(Continued)

FOREIGN PATENT DOCUMENTS

| | | |
|---|---|---|
| DE | 236726 | 9/1910 |
| EP | 0019284 | 11/1980 |

(Continued)

*Primary Examiner* — Tyrone V Hall, Jr.
*Assistant Examiner* — Abbie E Quann

(57) ABSTRACT

A portable lifting jack has a drivable mechanism operating a jack shaft formed of telescoping lifting screws. A microprocessor controls power to selectively turn electric motor to drive the operating mechanism. An in-line current draw sensor senses electric load of the motor and communicates this to the microprocessor. One detected electrical load is an electric load spike indicative that the jack shaft has contacted a mechanical load. A potentiometer connected to the operating mechanism senses extended position of the telescoping lifting screws and communicates this position to the microprocessor, which is programmed to derive when snug contact is achieved with an encountered mechanical load and to pause operation of the electric motor. In a synchronized array of jacks, all are paused to await further operator input, which may be coordinated through a remote control.

9 Claims, 5 Drawing Sheets

(56) References Cited

U.S. PATENT DOCUMENTS

| | | | | |
|---|---|---|---|---|
| 2015/0175393 | A1 | 6/2015 | Poke | |
| 2016/0130123 | A1 | 5/2016 | Young | |
| 2016/0214839 | A1 | 7/2016 | Boudreau | |
| 2018/0194601 | A1* | 7/2018 | Van Houten | B66F 7/20 |
| 2019/0248634 | A1* | 8/2019 | Stapensea | B66F 5/04 |

FOREIGN PATENT DOCUMENTS

| | | | |
|---|---|---|---|
| EP | 0247578 | A1 | 12/1987 |
| EP | 0538208 | A1 | 4/1993 |
| EP | 0697366 | A1 | 2/1996 |

* cited by examiner

SMART JACK ARRAY

BACKGROUND OF THE INVENTION

Field of the invention—The invention generally relates to instruments or apparatus for applying pushing or pulling force and especially to vehicle body lifters. The invention provides portable means for controlling body elevation or tilt of a lifted vehicle. Individual ground engaging means are individually movable. Further, the invention relates to portable devices such as jacks that apply a lifting or pushing force directly to the surface of a load. Jacks are adapted for uninterrupted lifting of loads and are screw operated with telescoping sleeves. The jacks have self-contained electric driving motors. The invention further relates to the use of a combination of several jacks associated for interrelating lifting or lowering movements.

Description of Related Art including information disclosed under 37 CFR 1.97 and 1.98—Mobile jacks for cars are used both singly and in combination for mixed purposes. An initial purpose is to raise a limited part of the car for a short term project such as to allow a wheel change, where no one is required to be under the lifted part of the car. Because of the short term and also because a worker is not placing himself under the car, the mobile jack may suffice to both lift and maintain the car at elevation.

A second purpose is to lift an entire car, often for a longer term purpose. The nature of a mobile jack often does not provide safe and secure long term support. After a car has been jacked-up, a jack stand can be inserted as a long term support, as well as a prudent safety measure any time a car is jacked regardless of duration and certainly at any time when a worker us under the car. Even with jack stands available, it can be particularly risky to raise a car at more than one jacking point. When a car is being jacked-up by a single jack at a single point, elevating the car is combined with application of lateral shifting force that might be successfully resisted by the friction of at least some car tires against the ground. Where a single jack is used at successive positions to insert jack stands at each, there is increased risk because of the application of lateral shifting forces combined with fewer tires on the ground to resist the lateral forces. With increased lateral movement of the car, it is increasingly possible that a jack stand will slip or tip.

Multiple mobile jacks can be used to lift an entire car or other load. For safest operation, the mobile jacks must be operated in a combined manner to avoid lateral shifting of the load. Coordinated operation of the multiple mobile jacks can be critical to safety. Where the car or other load is to remain elevated for more than a short term, mobile jacks present a further problem because an unsupported jack may fail, resulting in a tipped load. To avoid this possibility, jack stands can be placed at each jacking point, substituting for or supplementing the mobile jack to support the load. However, jack stands present clearance problems because they are of fixed height or can only change height in increments, which require that the associated jack can exceed the height of the jack stand and then lower the load onto the jack stand. This extra jacking height to clear the jack stand can be viewed as lost height. Particularly with various high performance cars, the ground clearance can be low, and a suitable mobile jack might be of a special, low clearance design in order to fit under the performance car. The low clearance jack may be incapable of supplying a useful jacking height to accommodate insertion of a jack stand, particularly when lost height is considered. To maintain maximum achievable height of a performance car, this temptation is added to maintain the car on jacks and to forgo the safety advantages of substituted jack stands.

It would be desirable to have a smart jack array, particularly one with low clearance capability, to increase the safety of multiple point jacking.

It would be desirable to have an array of smart jacks that can be operated at a safe distance from a car or other load being jacked, so that the operator is safe from accidents.

It would be desirable to have means for controlling an array of jacks with informational feedback to the operator reporting status of the jacking operation.

It would be desirable to have an array of coordinated mobile jacks for lifting a car or other load, wherein the jacks are suited for long term support of the load.

To achieve the foregoing and other objects and in accordance with the purpose of the present invention, as embodied and broadly described herein, the method and apparatus of this invention may comprise the following.

BRIEF SUMMARY OF THE INVENTION

The invention is a vehicle jack assembly that also serves as a long term jack stand under the lifted vehicle. Initially, the mechanisms of the jack assembly, such as motors and gearing, circuit board, battery, and jack elements are contained in a low profile, rectangular housing so that the jack is suitably sized to fit under high performance vehicles, which are notable for their low ground clearance. This functional combination is particularly useful with low clearance vehicles, because previously available jack stands are set at separated spacing intervals with the result that they are not precise in height and could sacrifice needed clearance to insert a jack stand in place of a precise jack.

Second, the low profile housing has a broad footprint, which provides good stability both during the jacking process and, subsequently, during extended use as a jack stand.

Third, the jack elements are mechanically stable and fail-proof to provide reliable long term support under a raised vehicle, with suitable fail-proof elements being a multi-stage screw that when extended rests on a strong thread, i.e., an Acme thread.

Fourth, the jack is electrically operated by battery power using a remote control.

Fifth, it is feasible to employ a plurality of such jacks in order to raise as much as the entire vehicle, with the broad footprint stabilizing the jack assembly and the vehicle during lifting operation. A motor and gear arrangement employs a dual motor combination with a linear gear train. The invention solves problems of low clearance jacking and suitability to serve as a long term jack stand.

According to the invention, a portable lifting jack has a drivable mechanism operating a jack shaft formed of telescoping lifting screws. A microprocessor controls power to selectively turn electric motor to drive the operating mechanism. An in-line current draw sensor senses electric load of the motor and communicates this to the microprocessor. One detected electrical load is an electric load spike indicative that the jack shaft has contacted a mechanical load. A potentiometer connected to the operating mechanism senses extended position of the telescoping lifting screws and communicates this position to the microprocessor, which is programmed to derive when snug contact is achieved with an encountered mechanical load and to pause operation of the electric motor. In a synchronized array of jacks, all are paused to await further operator input, which may be coordinated through a remote control.

The invention favors the use of mechanical screws as lifting devices. A hydraulic or pneumatic electric jack would not have position lock. Over time, the fluid or air in those types of jacks will compress, leak, or otherwise fail in some way and allow the load to fall back down, perhaps slowly, although if valving were to burst under pressure, the jack would fall suddenly. A mechanical screw can be configured to never back down purely due to load, given an appropriate thread pitch, a certain amount of lubrication, and a certain amount of contacting surface area. Using these factors, the mechanical screws of the invention are configured to not back down under any loading. In addition to the use of frictional self-locking of the screw threads, the microprocessor is programmed to use the electronic speed controller to apply a braking force to the motor and, thus, to the screws. When power is cut, a normal motor is expected to keep spinning. In the jack of this invention, the braking force is applied immediately after lifting has stopped, which brakes the movement of the screws and prevents their spinning under momentum.

Opposite from the braking mode, ramp-up is a unique ability to increase the power to the motor incrementally on start-up. Using ramp-up makes starting a smoother transition, making it safer and more stable for the jack to lift. Ramp-up also limits stress on the screws and motors. Applying known features such as microprocessor controlled braking and ramp-up at start-up is unique in application to electronic jacks.

The accompanying drawings, which are incorporated in and form a part of the specification, illustrate preferred embodiments of the present invention, and together with the description, serve to explain the principles of the invention. In the drawings:

DETAILED DESCRIPTION OF THE INVENTION

Figure 1:
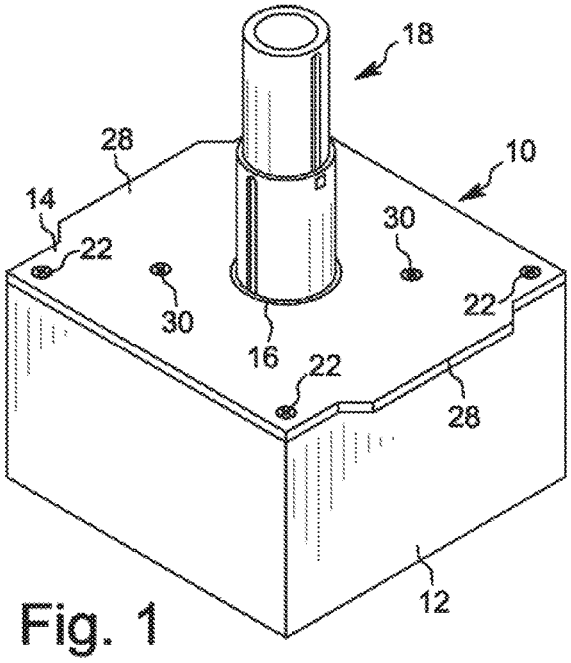
FIG. 1 is an isometric view of an assembled smart jack assembly taken from a top and side viewpoint, showing an extended jack column.

The invention is directed to improvements in the utility and control of a smart jack and multi-jack array. With reference to FIG. 1, the illustrated smart jack 10 is a representative single unit that functions with software support through a remote control to raise and lower an applied load. In this disclosure, the applied load may be referred to as being a vehicle, without limiting the scope of the disclosure from teaching the jacking of any other type of applied load. The smart jack is designed to accommodate usage in an optional array of the same or similarly functioning units 10 to broaden the jacking potential from a single lifting point to multiple lifting points. The expanded embodiment employing multiple units 10 accommodates lateral balance issues with coordinated operations that are not necessarily limited to duplications of identical performance among all units. Instead, operational control systems detect the jacking configuration of an applied load and establish matching configuration through custom sensing and control of the units 10.

Figure 2:
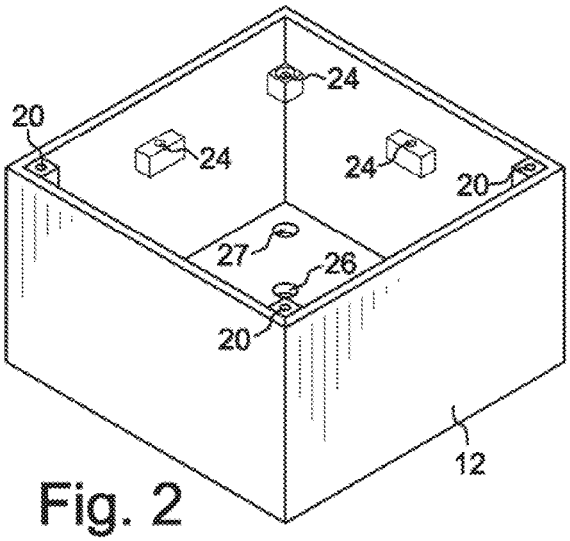
FIG. 2 is an isometric view of a case for a smart jack assembly taken from a top and side viewpoint, showing fastening points and supports for a jack mechanism.

A single smart jack unit 10 as shown in FIGS. 1 and 2 provides a housing base 12 that contains operational components of the smart jack. The base housing is closed by a lid 14 that seals the base housing against entry of fluids or solid debris. The lid is configured with a through passage 16 for a jack shaft 18. Inside housing base 12 are mounting blocks 20 near the open top of the base 12, equipped with mounting holes to receive lid fastening screws 22. Additional mounting blocks 24 are located deeper in the base to provide fastening points to the chassis for proximately positioned elements of the operational components. A bottom structure or floor panel of the base housing 12 is configured with shaft reception holes or sockets 26 in suitable number and at suitable positions to receive bushings, bearings or lower ends of gear shafts. A socket or reception hole 26 is centrally positioned on the floor panel of the housing to receive a thrust bearing and lower shaft end associated with the main drive gear to concentrate and center all axial loading in a concentric position within the base housing 12. For purposes of description and not limitation, the bottom of housing 12 may be regarded as a horizontal surface and reception hole 26 and other similar holes in the bottom may be regarded as being vertical or disposed on a vertical axis. Accordingly, a similar vertical socket or hole 27 is located at a position to properly space a drive pinion gear at a tangent position to the main drive gear so that the pinion can function under high load. The lid 14 is configured with hand holds 28 to aid the user in carrying and positioning the smart jack unit 10. The lid also serves as a positional anchor for non-rotary operational components. For example, the screws 30 fasten a rotation limiter of the operational components in a fixed rotational orientation with respect to the lid, and hence, with respect to the housing base, itself.

The operational components of the smart jack are best seen in FIGS. 3-7. In a preferred embodiment, the jack shaft 18 is formed of three threaded sections that can be rotated or axially advanced to extend or contract the shaft. An Acme thread is suitable for use on the shaft sections that are mutually rotatable to give the jack shaft a high lifting capacity. The interconnections among the shaft sections can follow the scheme shown in FIGS. 6 and 7 and described as follows. A pin 32, FIG. 7, establishes an interference fit for common rotation between main drive gear 34 and a first lifting screw 36 of the jack shaft 18. The bottom end 38 of the first lifting screw 36 extends through the center of the drive gear 34 and into a bushing installed in the floor panel of the housing in a concentrically located recessed socket or hole 26, such that the lifting screw 36 and gear 34 rotate on a common vertical axis of reception hole 26. The first lifting screw 36 is externally threaded and rotationally mates with an internally threaded portion of a hollow, second lifting screw 40. The second lifting screw 40 also has an externally threaded portion that, in turn, is threaded to rotationally mate into an internally threaded portion of a third and final lifting screw 42. The threads on these lifting screws are crimped at their ends or otherwise equipped with restrictions to prevent unthreading.

The third lifting screw is joined to the housing, directly or indirectly, to allow mutual axial or longitudinal movement but to limit relative rotational movement. This may be achieved by employing an optional first, external, linear, axial slider, which may be a telescoping first sleeve 48 that encircles the third lifting screw. The first sleeve 48 can be engaged with the third lifting screw for relative axial, telescoping, sliding movement, to allow the third screw to extend or retract during the operation of the jack shaft. Likewise, the first sleeve 48 can move axially so as to not limit the axial extension of the third screw or of the jack shaft, itself. The first sleeve 48 also can serve as an interface or intermediate member to be engaged by an external, linear, axially sliding carrier 58, which may be configured as an external, telescoping, second sleeve 58. The first and second sleeves may be interconnected to allow relative axial telescoping or sliding movement to permit axial extension and retraction of the jack shaft. In concept, the series of telescoping sleeves is not limited to one or two, but in the presently described and illustrated embodiment of the jack 10, two sleeves are sufficient. The two sleeves are rotation limiting, such as by junction on a linear, axial track. The outer sleeve 58 is connected to the housing 12, directly or indirectly, such as through a mechanical securing plate or bracket, and the bracket may be joined initially to the lid 14, which then will be attached to the housing base 12.

In a detailed example, the outside of the third lifting screw may be unthreaded or otherwise regarded as smooth so as to smoothly slide with respect to the first slider or first sleeve 48. The outside surface of the third screw has formed thereon an axial, recessed track 44, preferably with closed ends to retain a guide element sliding in the track 44. Telescoping first sleeve 48 is connected to the track 44 by such a guide element, which may be a pin 46 that axially guides telescoping movement between the first sleeve and the third screw, while also limiting rotation. The form of the first slider 48 is preferred to be a cylindrical sleeve that closely fits around the final or third screw 42 to retain the pin 46 in track 44.

The outside of the first sleeve 48 may be smooth so as to smoothly slide in relation to external carrier 58. An axial, recessed track 50 is formed in the outer surface of the first sleeve and preferably has closed longitudinal ends to retain a guide element sliding in the track 50. The guide element operating between carrier 58 and track 50 may be a pin 52. Where the carrier 58 is a second or external sleeve, it is preferred that the carrier is a cylindrical, second sleeve that closely fits around the first slider to retain the pin 52 in track 50. Pin 52 operating in track 50 axially guides telescoping movement between first and second sleeves while also limiting rotation. The second sleeve 58 is a joining component of a rotation limiter 54 that is also joined to lid 14 to limit rotation of the final screw 42. Where the extended length of the jack shaft permits, the first sleeve 48 may be omitted, and the pin 52 of the second sleeve 58 may be engaged with the track 44 of the third or final lifting screw as a component of the rotation limiter.

As previously described, the rotation limiter 54 is mounted to the lid 14 of the smart jack 10, which is mounted directly to the housing base 12. The rotation limiter 54 is formed of both a bracket or horizontal securing plate 56 that is parallel to the lid 14 and directly fastens against the lid 14, and a carrier sleeve 58 that is fixed to the securing plate 56 and carries telescoping sleeve 48 for axial movement. The purpose of the rotation limiter 54 is to lock the lifting screws 36, 40, 42 into moving differentially and extending or receding.

Mechanical lifting screws 36, 40, 42 serve as lifting devices and as a position lock. These mechanical screws are configured to never back down merely under load pressure. The screws employ frictional self-locking of the screw threads and an associated microprocessor 84 is programmed to use an electronic speed controller 80 to apply a braking force to a drive motor 66, 68 and, thus, to the screws. When power is cut, a normal motor is expected to keep spinning. In the jack 10 of this invention, the braking force is applied immediately after lifting has stopped, which brakes the movement of the screws and prevents their spinning under momentum.

Functionally, the jack shaft 18 operates by rotation of the main drive gear 34. The first lifting screw 36 rotates with the drive gear 34 in either selected direction but is not axially movable due to the pinned engagement with the drive gear. The third lifting screw 42 operates axially but cannot rotate or is limited in its rotation. This limitation is established by axial track 44 on the third lifting screw, having pinned connection 46 to telescoping sleeve 48; and sleeve 48 has an axial track 50 that is held against rotation by pinned connection 52 to the carrier sleeve 58 of the rotation limiter, which is non-rotatably fastened to the lid 14. Due to these described limitations in modes of movement among the three lifting screws, the second lifting screw 40 is the only one of the three screws that is capable of both axial and rotational motion. The crimped ends of the lifting screws or other restriction against unthreading serve as a mechanism to ensure that both second and third lifting screws will move axially in response to rotation of the first lifting screw.

Figure 5:
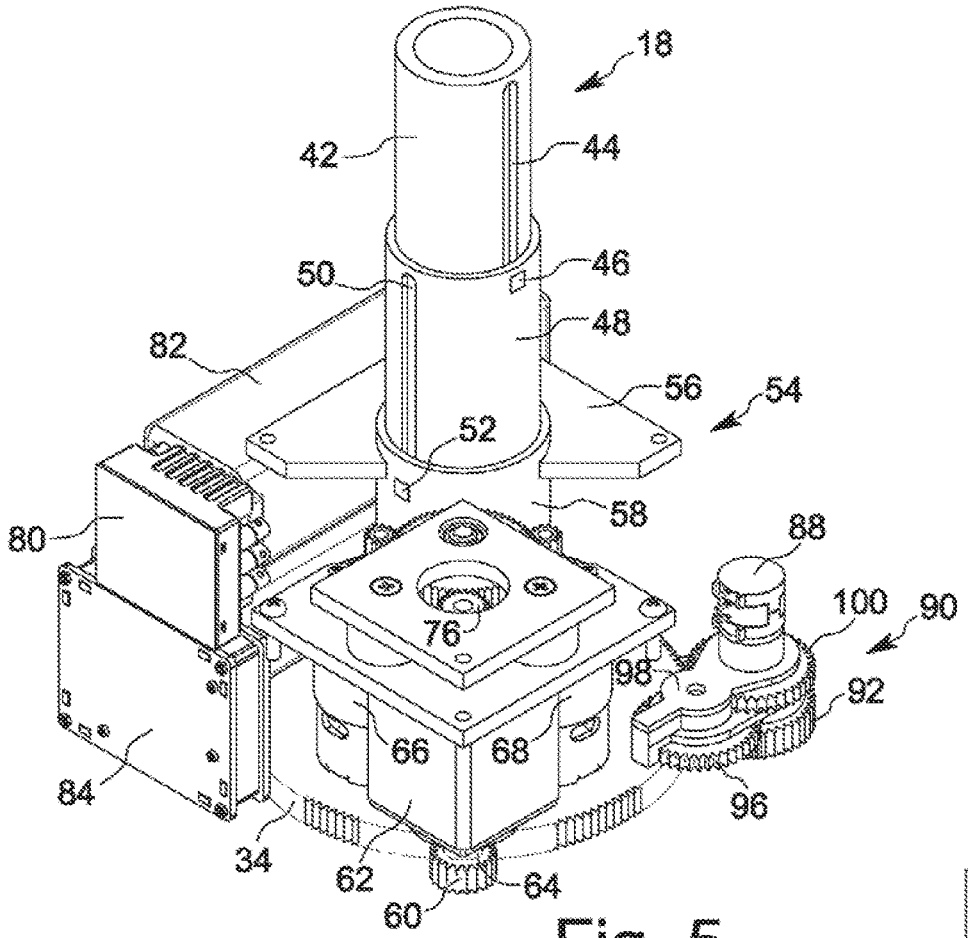
FIG. 5 is a isometric view of the jack mechanism of FIG. 3, taken from a top and side viewpoint.
Figure 6:
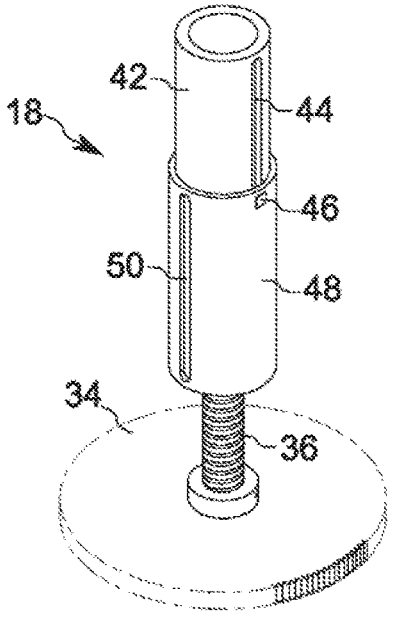
FIG. 6 is an isometric view of a lifting screw assembly of the jack column, taken from a top and side viewpoint.
Figure 7:
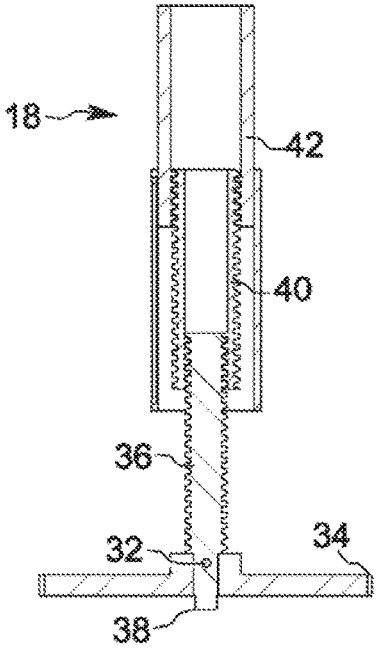
FIG. 7 is a vertical cross-section of the lifting screw assembly of FIG. 5.

A portion of the smart jack may be generally referred to as being the gearbox. This portion drives the main drive gear 34 in either direction. As shown in FIG. 5, a pinion gear 60 drives the main drive gear 34 in either selected direction according to the applied direction of drive motors. A planetary reduction gearbox 62 carries the output pinion gear 60 at its bottom, attached to an output shaft 64 and also, optionally, carried in a reception socket 27 in the floor panel of the housing 12. The output shaft 64 or other centering element of pinion gear 60 provides the optional engagement in socket 27 below the pinion gear 60 to support the gear 60 under load in tangent position to drive gear 34.

Figure 3:
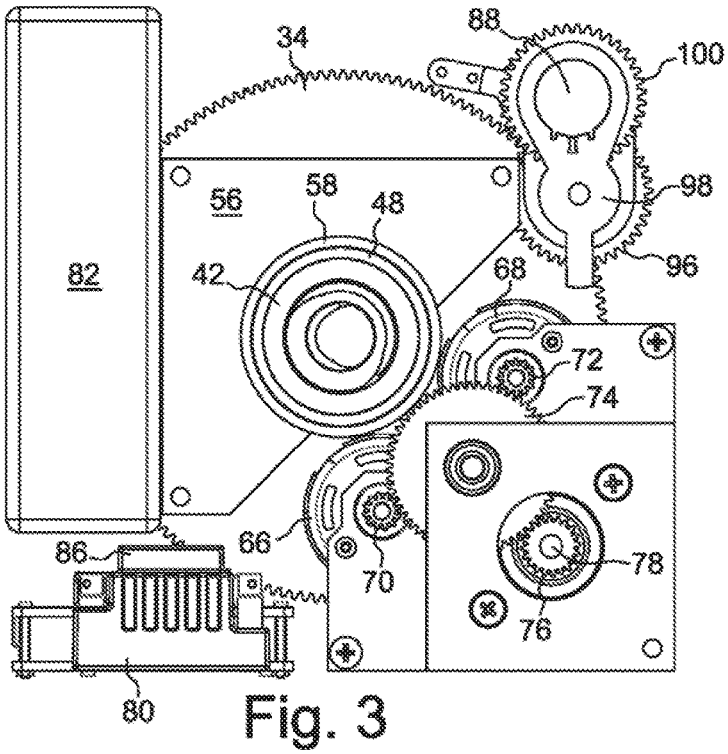
FIG. 3 is a top plan view of a jack mechanism apart from the case of FIG. 1.

As best shown in FIG. 3, one or more electric motors drive the planetary reduction gearbox through suitable intermediate gears. Preferably two electric motors 66, 68 are used, each driving the reduction gearbox through respectively associated idler pinion gears 70, 72. These idler pinion gears drive a larger idler gear 74, which drives the planetary reduction gearbox through an input pinion gear 76 mounted on an input shaft 78 at the top of the planetary reduction gearbox.

Figure 11:
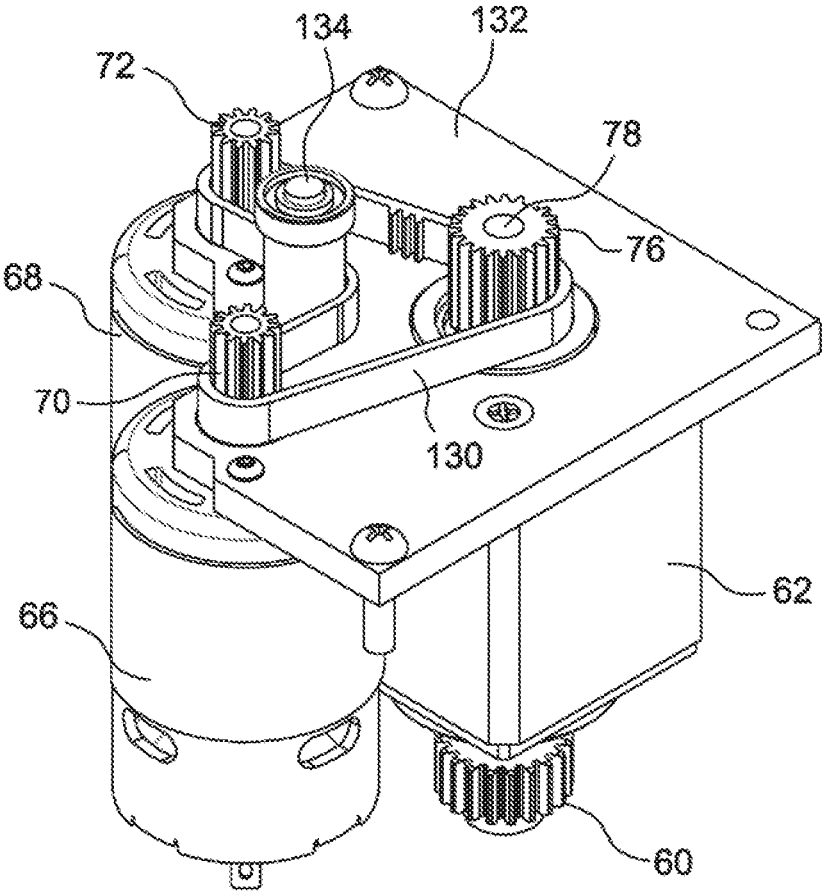
FIG. 11 is an isometric view of a jack mechanism taken from a top and side viewpoint, showing a drive train using a timing belt between the motors and the planetary reduction gearbox.

As shown in FIG. 11, another drive train between the electric motors 66, 68 and reduction gearbox 62 employs a timing belt 130, which is conventionally toothed to engage gears on components of the drive train. A mounting plate 132 secures both motors 66, 68 and the gearbox 62 at fixed relative spacings. The path of the timing belt partially wraps motor output pinions 70, 72 and gearbox input pinion 76. An eccentric belt tensioner 134 is carried on mounting plate 132 in a partially wrapped position to enable loosening or tensioning the timing belt.

An electronic speed controller 80 is connected to a power supply such as a battery, optionally a pair of batteries 82, and to the electronic motors 66, 68 to control motor speed. A microcontroller 84 is attached to and controls the electronic speed controller 80. An inline amp meter 86 is functionally located between the electronic speed controller 80 from the batteries 82 and is wired to communicate with the microcontroller 84.

Figure 4:
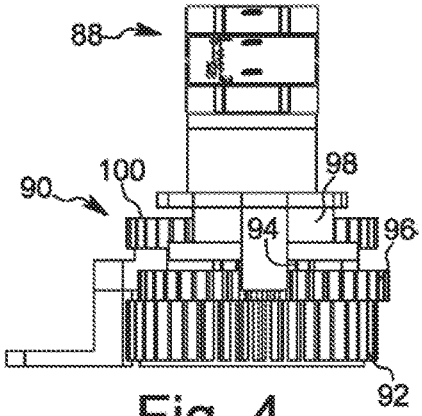
FIG. 4 is a front elevational view of the rotary potentiometer shown in FIG. 3.

With reference to FIGS. 3, 4, and 5, a rotary potentiometer 88 is connected to receive input from the drive gear 34 and is connected to the microcontroller 84 to control discrete lifting levels of the jack shaft 18. The inclusion and design of the rotary potentiometer 88 in the smart jack 10 allows a determination of the exact location of each of the lifting screws at all times. This knowledge provides numerous safety benefits and features, particularly in conjunction with other sensors available in the smart jack. The microcontroller controls all logic functions, reads potentiometer values, performs all mathematical functions, and supplies motor control input. With an array of multiple smart jacks 10 working synchronously to lift a vehicle, the jacks 10 are able to communicate with each other not only to synchronize lifting, but also to level the vehicle and to ensure the jacking is done safely. By keeping the vertical position fenced around the slowest jack, it can be ensured that any corner of the vehicle is not lifted too quickly, which otherwise could result in an unstable, dangerous condition.

In communicating with the amp meter 86, which serves as an in-line current draw sensor of the motor's power supply, the smart jack 10 also is capable of performing a "snug" function. This operation is carried out by placing a smart jack 10 at each of the four corners of a vehicle and then running the "snug" function, wherein each jack shaft 18 will extend until the lifting screws of all four jacks 10 meet the underside of the vehicle. The amp meter 86 will notify the microprocessor 84 that the motors 66, 68 have encountered an applied load, and the smart jack 10 will wait to coordinate lifting with the other jacks 10, as described above. This use of the amp meter 86 further enhances safety by allowing the smart jacks to raise a vehicle at the attitude at which is sits on the ground—not raising or lowering the front, rear, left or right corner of the vehicle before the smart jack reaches its functional jacking height. In many cases the jacking points will be at uneven heights, which will necessitate an ability for jacks 10 to raise the vehicle at multiple points to have adjustability. In the smart jacks 10, this process is automated.

From the jacking elevations determined using the snug function, a user can choose to raise or lower any corner of a vehicle to simulate different vehicle attitudes. Examples of simulations include airplanes, watercraft, and loaded or unloaded trucks. Through all of this time, the microprocessors in the smart jacks are working to raise or lower all jacks concurrently.

A compound reduction gearbox is driven by the main drive gear 34 and is attached to the rotary potentiometer. The rotary potentiometer is wired to the microcontroller. The drive gear 34 communicates with the rotary potentiometer 88 through a compound gearbox 90, which scales the input from the drive gear 34. The design of a compound gearbox 90 can reach a desired result with considerable variation. As an example of a compound gearbox 90, the drive gear 34 engages an input gear 92 at the bottom level of the compound gearbox. Input gear 92 is smaller than drive gear 34, thereby rotating faster than the drive gear 34 by a multiplier which may be about four or five. A smaller midlevel gear 94 is located on top of input gear 92, at a midlevel of the gearbox 90, and is keyed to rotate coaxially with input gear 92. Gear 94 drives a larger midlevel gear 96, which rotates at a decreased speed relative to gear 94. A smaller top level gear 98 is located on top of midlevel gear 96 and is keyed to rotate coaxially with midlevel gear 96. Top level gear 98 engages a larger top level gear 100 that directly rotates the rotary potentiometer 88. The keyed relationships and the driven relationships between gears of different sizes in the compound gearbox 90 allow latitude in establishing a desired rotation of the rotary potentiometer 88 according to the speed or speed range of the drive gear 34.

The microcontroller 84 uses inputs from the potentiometer 88 to limit vertical extension of the second lifting screw 40 and third lifting screw 42 to minimum and maximum levels, for safety. Voltage readings from the potentiometer correspond to lift values, which can be calibrated based on resolution to be accurate within 0.01 inch. The potentiometer enables the jack to have many built-in safety features such as making sure all meshed jacks are at the same height, which ensures that the vehicle is level, and manages minimum and maximum lift to create reliable lifting boundaries. In addition, the microcontroller 84 can utilize the potentiometer 88 to control discrete lifting levels, monitoring the lifting height of all jacks 10 in a multi-jack array to facilitate simultaneous lifting. The potentiometer 88 allows the user to level the applied load to different heights at each jack point, for example at four corners of a vehicle when using a four jack array. The microcontroller 84 uses the inline amp meter 86 to determine whether the first, second and third lifting screws 36, 40, 42 are loaded by sensing current draw spikes from the electronic motors 66, 68. The microcontroller 84 uses the inline amp meter 86 to facilitate a "snug function" by allowing each smart jack to be run upwards until the third lifting screw 42 contacts the underside of the vehicle. By utilizing the "snug function" with an array of four jacks 10, the smart jack array 10 is capable of lifting the vehicle simultaneously at all four corners, thereby enhancing safety and adaptability to jack different vehicles and use different jacking locations.

When starting a jacking process, the microprocessor operates the motors in a ramp-up mode, which is a unique ability to increase the power to the motor incrementally on start-up. Using ramp-up makes starting a smoother transition, making it safer and more stable for the jack to lift. Ramp-up also limits stress on the screws and motors.

Figure 8:
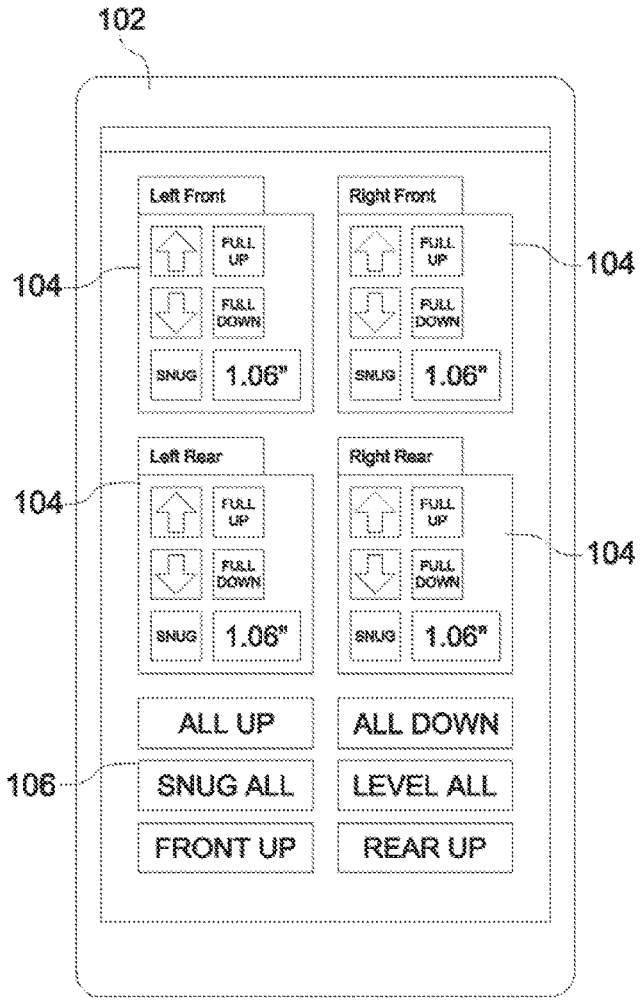
FIG. 8 is a first interface screen display for controlling a smart jack array.
Figure 9:
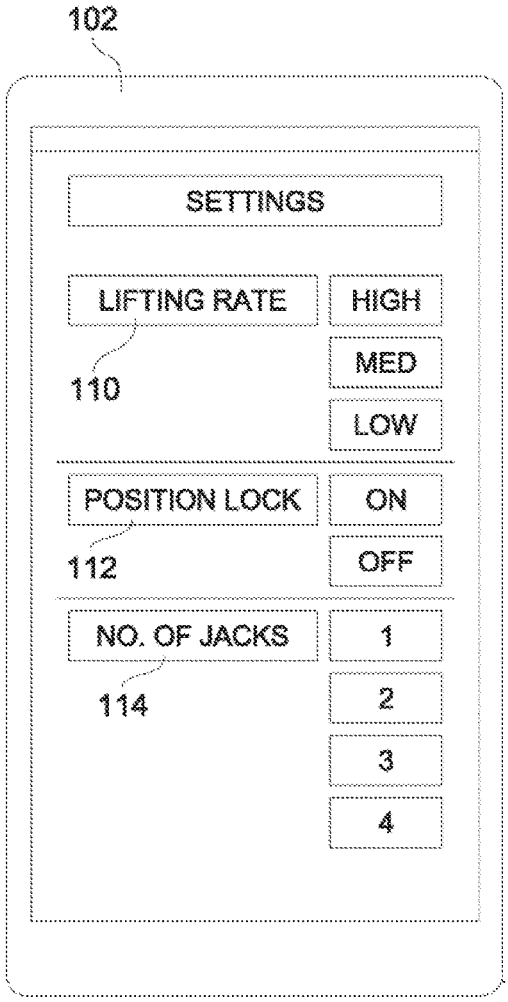
FIG. 9 is a second interface screen display for controlling a smart jack array.

The microcontroller 84 uses a bluetooth or other chip 118 such as an RF chip to communicate over a wireless connection to receive input from a remote, wireless controller 102 such as a phone application or a dedicated controller, and uses the wireless protocol to communicate with up to four other smart jack units. With reference to FIGS. 8 and 9, a phone application or dedicated remote control 102 can offer the illustrated features. A touch screen or button array on remote controller 102 accommodates an array of four smart jacks and suggests a coordinated placement for each jack by designating control groupings 104 under headings such as left front, right front, left rear and right rear. The control groupings 104 offer selections such as "up arrow", "full up", "down arrow", or "full down", and also offer the snug function, together with a readout of jack shaft height when the snug function is satisfied. A further array of controls 106 address group functions such as "all up", "all down", "snug all", "level all", "front up", and "rear up". FIG. 9 shows a further touch screen or button array 102 that controls of a selected jack 10 or array of jacks with such features as a designated lifting rate 110 choosing from high, medium, and low; a position lock 112 designated as on or off; and the number of jacks 114 designated as one, two, three, or four. The phone application or dedicated remote 102 has at least these described functions of raising, lowering, leveling the vehicle, locking individual jacking heights to each other and "snugging" the first, second and third lifting screws to the vehicle.

Figure 10:
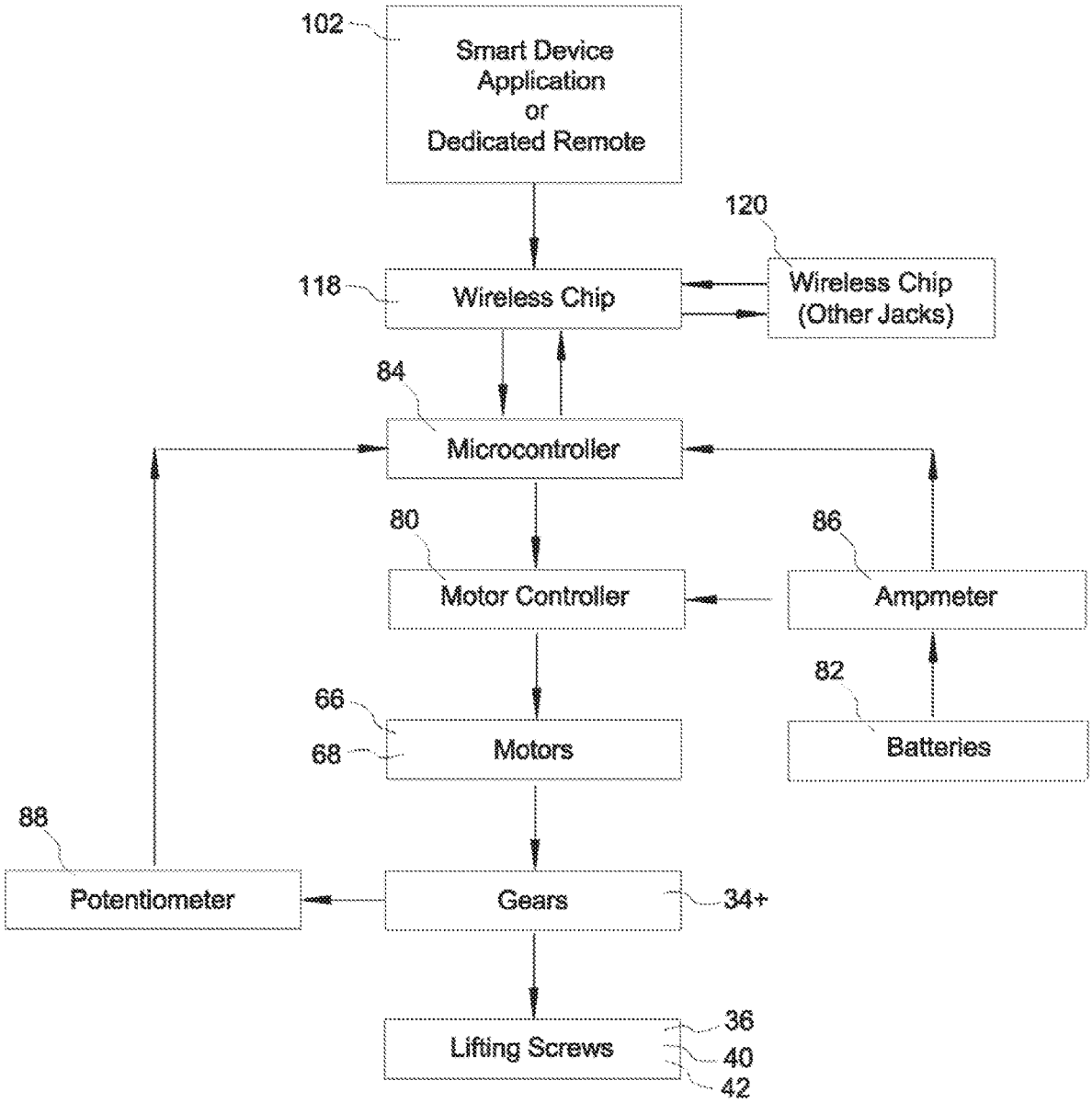
FIG. 10 is a flow chart for a process controlling a smart jack array.

The process diagram of FIG. 10 shows the arrangement and interconnection of components for operating the smart jack array. An operational control device 102 can be a dedicated remote control or a software application that runs on a generalized computer such as a tablet computer or hand held smart phone. The diagram of FIG. 10 primarily shows operation of a single jack, but operation of an array of jacks also is described and enabled. A wireless chip 118 enables a protocol such as Bluetooth or RF communication and allows communication between the control device and a single jack. Additional wireless chips 120 associated with the other jacks of an array expand communication to those other jacks. With a wireless protocol such as WIFI or Bluetooth, the smart jack is capable of communicating with up to three other instances of itself, communicating with a smart device or dedicated remote through a single "parent" jack. By monitoring the lifting movement, rate and level of other linked jacks, the system is safer and more capable. The wireless chips provide two-way communications to the microcontroller 84 of the single jack, optionally including the other jacks.

An amp meter 86 is wired between the power supply 82, typically a battery, and the electronic speed control 80 for the motors. The amp meter 86 monitors current supplied to the motor controller 80 and, thus, to the motors. The purpose of this monitoring is to detect when the motors reach the underside of the vehicle and begin to lift, thus drawing more current. One mode of operating the microcontroller is to run the motors until the jack shaft reaches the underside of the car and then to stop and wait for further input. This arrangement employs the amp meter 86 to monitor current draw to the motor and to communicate the current draw to the microcontroller 84. The motor controller 80 directs appropriate available power to the motors 66, 68 for operation in either direction. The direction and speed of the motors 66, 68 control the operation of gears, inclusive of, but not limited to, the drive gear 34. The gears operate the lifting screws 36, 40, 42, while also communicating data readings indicative of lifting screw status to the potentiometer 88. The potentiometer 88 recognizes and communicates lifting screw data to the microcontroller 84.

The rotary potentiometer 88 is mated to the drive gear 34 of the smart jack. By calibrating read values from the factory, an equation is derived and provides highly accurate readings, to one hundredth of an inch, of the total lifting height of each smart jack. This information is used to balance the height and rate of all jacks in the system, and also to provide lower and upper bounds of the lifting screws in operation.

The potentiometer 88 can be set for readout accuracy by zeroing, which can be a test bench operation. Zeroing refers to, first, associating the minimum lift with the potentiometer reading and setting that as the zero point, or 0% lift. Then the maximum lift is associated with the potentiometer reading at the maximum point and that is set as 100% lift. The steps are, first, to read voltage at minimum deflection of the smart jack. In this context, this deflection refers to a potentiometer value at minimum lift. Second, read voltage at maximum deflection, where this deflection refers to potentiometer value at maximum lift. Third, divide the difference between maximum and minimum deflection by the number of resolution steps between. This provides the voltage increase expected per step increase, as well as the number of expected steps. Dividing the known lifting displacement in inches by the number of known steps between both potentiometer values allows determination of the inch value of each potentiometer tick. Next, subtract the voltage at minimum deflection from maximum and minimum deflection. This is literally zeroing the potentiometer values to read from zero instead of an arbitrary value. An example of potentiometer performance might use to a potentiometer reading from zero to 1024 and each integer in-between. It is not expected to be perfectly at zero at zero lifting. It may be set at a low value such as 3 out of 1024 at minimum lift and 1021 out of 1024 at maximum lift.

In use of the potentiometer, first, read analog voltage of the potentiometer. Second, zero the potentiometer reading. This is done by subtracting minimum deflection voltage from the test bench. Finally, divide the maximum deflection (zeroed) by the current potentiometer reading. This is the percentage of maximum extension.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

What is claimed is:

1. A lifting jack for elevating an encountered mechanical load, comprising:

an axially telescoping jack shaft formed of multiple coaxial lifting screws;

a housing containing a main drive gear configured when driven to extend the axially telescoping jack shaft by rotating the multiple coaxial lifting screws;

an electric motor connected to the main drive gear and configured to drive the main drive gear to extend the multiple coaxial lifting screws when the electric motor turns in a first rotational direction;

a power supply selectively providing power to rotate the electric motor;

a microcontroller connected between the power supply and the electric motor to selectively cause the electric motor to be powered to rotate in the first rotational direction;

an in-line current draw sensor arranged to sense an electric load of the electric motor and to communicate the electric load to the microcontroller, including sensing an electric load spike indicative that the axially telescoping jack shaft has extended into contact with the encountered mechanical load;

a potentiometer connected to the main drive gear to sense a position of the multiple coaxial lifting screws, the potentiometer being connected to the microcontroller to communicate the position to the microcontroller;

the microcontroller having suitable processing instructions to receive the electric load and the position and to determine achievement of snug contact between the axially telescoping jack shaft and the encountered mechanical load;

the housing comprising sides and a bottom and defining an upwardly open reception socket in the bottom, the reception socket located at a spacing from the sides of at least a radius of the main drive gear, the main drive gear being centered on the reception socket, and the axially telescoping jack shaft comprising a first lifting screw attached to a center of the main drive gear;

the axially telescoping jack shaft further comprising a second lifting screw, a third lifting screw, and an external sleeve, the main drive gear and the first lifting screw being joined for common rotation, the first lifting screw being externally threaded, the second lifting screw having a hollow center that is internally threaded and receiving the first lifting screw therein in threaded engagement, the second lifting screw being externally threaded, the third lifting screw having a hollow center that is internally threaded and receiving the second lifting screw therein in threaded engagement, the external sleeve being positioned around the third lifting screw in axially slidable, rotationally limited engagement; and a rotation limiter connected between the external sleeve and the housing, wherein the rotation limiter comprises a carrier sleeve positioned around the external sleeve in axially slidable, rotationally limited engagement, and a bracket connecting the carrier sleeve to the housing.

2. A lifting jack for elevating an encountered mechanical load, comprising:

an axially telescoping jack shaft formed of multiple coaxial lifting screws;

a housing containing a main drive gear configured when driven to extend the axially telescoping jack shaft by rotating the multiple coaxial lifting screws;

an electric motor connected to the main drive gear and configured to drive the main drive gear to extend the multiple coaxial lifting screws when the electric motor turns in a first rotational direction;

a power supply selectively providing power to rotate the electric motor;

a microcontroller connected between the power supply and the electric motor to selectively cause the electric motor to be powered to rotate in the first rotational direction;

an in-line current draw sensor arranged to sense an electric load of the electric motor and to communicate the electric load to the microcontroller, including sensing an electric load spike indicative that the axially telescoping jack shaft has extended into contact with the encountered mechanical load;

a potentiometer connected to the main drive gear to sense a position of the multiple coaxial lifting screws, the potentiometer being connected to the microcontroller to communicate the position to the microcontroller;

the microcontroller having suitable processing instructions to receive the electric load and the position and to determine achievement of snug contact between the axially telescoping jack shaft and the encountered mechanical load;

the housing comprising sides and a bottom and defining an upwardly open reception socket in the bottom, the reception socket located at a spacing from the sides of at least a radius of the main drive gear, the main drive gear being centered on the reception socket, and the axially telescoping jack shaft comprising a first lifting screw attached to a center of the main drive gear;

the jack shaft further comprising a second lifting screw, a third lifting screw, and an external sleeve, the main drive gear and the first lifting screw being joined for common rotation, the first lifting screw being externally threaded, the second lifting screw having a hollow center that is internally threaded and receiving the first lifting screw therein in threaded engagement, the second lifting screw being externally threaded, the third lifting screw having a hollow center that is internally threaded and receiving the second lifting screw therein in threaded engagement, the external sleeve being positioned around the third lifting screw in axially slidable, rotationally limited engagement;

a rotation limiter connected between the external sleeve and the housing;

the third lifting screw further comprising an axial, recessed track on an external surface thereof; and a guide pin in sliding engagement with the axial, recessed track of the third lifting screw and in fixed engagement with the external sleeve, thereby establishing the axially slidable, rotationally limited engagement between the third lifting screw and the external sleeve.

3. The lifting jack of claim 2, wherein: the rotation limiter comprises a carrier sleeve positioned around the external sleeve in axially slidable, rotationally limited engagement; and a bracket connecting the carrier sleeve to the housing; the external sleeve comprises an axial, recessed track on the external surface thereof; and further comprising a guide pin in sliding engagement with the axial, recessed track of the external sleeve and in fixed engagement with the carrier sleeve, thereby establishing the axially slidable, rotationally limited engagement between the carrier sleeve and the external sleeve.

4. A lifting jack for elevating an encountered mechanical load, comprising:

an axially telescoping jack shaft formed of multiple coaxial lifting screws;

a housing containing a main drive gear configured when driven to extend the axially telescoping jack shaft by rotating the multiple coaxial lifting screws;

an electric motor connected to the main drive gear and configured to drive the main drive gear to extend the multiple coaxial lifting screws when the electric motor turns in a first rotational direction;

a power supply selectively providing power to rotate the electric motor;

a microcontroller connected between the power supply and the electric motor to selectively cause the electric motor to be powered to rotate in the first rotational direction;

an in-line current draw sensor arranged to sense an electric load of the electric motor and to communicate the electric load to the microcontroller, including sensing an electric load spike indicative that the axially telescoping jack shaft has extended into contact with the encountered mechanical load;

a potentiometer connected to the main drive gear to sense a position of the multiple coaxial lifting screws, the potentiometer being connected to the microcontroller to communicate the position to the microcontroller;

the microcontroller having suitable processing instructions to receive the electric load and the position and to determine achievement of snug contact between the axially telescoping jack shaft and the encountered mechanical load;

the axially telescoping jack shaft comprising at least a first lifting screw and a final lifting screw in rotational engagement, the first lifting screw axially extending the final lifting screw by relative rotation of the first lifting screw in a first rotational direction and axially retracting the final lifting screw by relative rotation of the first lifting screw in a second and opposite rotational direction; wherein the main drive gear is engaged to rotate the first lifting screw with respect to the housing;

an external slider engaging the final lifting screw in axial sliding, rotationally limited engagement; and a rotation limiter connected between the external slider and the housing, whereby the final lifting screw is limited in rotation relative to the housing.

5. The lifting jack of claim 4, wherein: the external slider is a first sleeve positioned around the final lifting screw; and wherein the rotation limiter further comprises: a carrier slider connected to the first sleeve in axially slidable, rotationally limited engagement; and a bracket connecting the carrier slider to the housing.

6. The lifting jack of claim 4, wherein: the final lifting screw further comprises an axial, recessed track on external surface thereof; and the lifting jack further comprises a guide pin in sliding engagement with the axial, recessed track of the final lifting screw and in fixed engagement with the external slider, thereby establishing axially slidable, rotationally limited engagement between the final lifting screw and the external slider.

7. The lifting jack of claim 4, wherein: the external slider comprises an axial, recessed track on an external surface thereof; and the rotation limiter comprises:

a carrier sleeve positioned around the external slider in axially slidable, rotationally limited engagement;

a bracket connecting said carrier sleeve to said housing; and a guide pin in sliding engagement with said axial, recessed track of said external slider and in fixed engagement with said carrier sleeve, thereby establishing said axially slidable, rotationally limited engagement between the carrier sleeve and the external slider.

8. An array of four lifting jacks for elevating an encountered mechanical load, comprising:

a remote control communicating with the four lifting jacks of the array; and wherein each lifting jack of the array comprises:

an axially telescoping jack shaft formed of multiple coaxial lifting screws;

a housing containing a main drive gear configured when driven to extend the axially telescoping jack shaft at the multiple coaxial lifting screws;

an electric motor suitably connected to the main drive gear to drive the main drive gear for extending the multiple coaxial lifting screws when the electric motor turns in a first rotational direction;

a power supply selectively providing power to turn the electric motor;

a microcontroller connected between the power supply and the electric motor to selectively cause the electric motor to be powered for turning in the first rotational direction;

an in-line current draw sensor arranged to sense an electric load of the electric motor when the main drive gear is driven and to communicate the electric load to the microcontroller, including an electric load spike indicative that the axially telescoping jack shaft has extended into contact with the encountered mechanical load;

a potentiometer connected to the main drive gear to sense a position of the multiple coaxial lifting screws and connected to the microcontroller to communicate the position to the microcontroller;

the microcontroller having suitable processing instructions to receive the electric load and the position to determine achievement of snug contact between the axially telescoping jack shaft and an encountered mechanical load; and a rotation limiter connected between the multiple coaxial lifting screws and the housing, wherein the remote control communicates with the microcontroller of each of the four lifting jacks with control selections arranged in control groupings designating placement of the four lifting jacks.

9. The array of four lifting jacks of claim 8, wherein the remote control provides a control selection to the microcontroller of each of the four lifting jacks to achieve the snug contact.

* * * * *